US007726366B2

(12) United States Patent
Liu

(10) Patent No.: US 7,726,366 B2
(45) Date of Patent: Jun. 1, 2010

(54) WOOD PLANING MACHINE INCLUDING A ROUGH-PLANE CUTTER AND A FINE-PLANE CUTTER

(75) Inventor: Chin-Yuan Liu, Taichung (TW)

(73) Assignee: Shinmax Industry Co., Ltd. (TW)

( * ) Notice: Subject to any disclaimer, the term of this patent is extended or adjusted under 35 U.S.C. 154(b) by 198 days.

(21) Appl. No.: 12/135,369

(22) Filed: Jun. 9, 2008

(65) Prior Publication Data

US 2008/0308185 A1 Dec. 18, 2008

(30) Foreign Application Priority Data

Jun. 12, 2007 (CN) ..... 2007 2 0146361 U

(51) Int. Cl.
*B27C 1/00* (2006.01)

(52) U.S. Cl. ..... 144/38; 144/114.1; 144/117.1; 451/65; 451/69

(58) Field of Classification Search ..... 144/38, 144/39, 114.1, 117.1, 116, 121, 129, 130, 144/1.1; 451/11, 65, 67, 69, 70
See application file for complete search history.

(56) References Cited

U.S. PATENT DOCUMENTS

| | | | | |
|---|---|---|---|---|
| 29,768 | A * | 8/1860 | Christian | 144/230 |
| 452,632 | A * | 5/1891 | Bennett | 144/39 |
| 750,294 | A * | 1/1904 | Matthiesen | 144/38 |
| 3,379,230 | A * | 4/1968 | Roehrig | 144/1.1 |

* cited by examiner

*Primary Examiner*—Shelley Self
(74) *Attorney, Agent, or Firm*—Bliss McGlynn, P.C.

(57) ABSTRACT

A wood planing machine includes a base adapted to permit a workpiece to be moved thereon in a front-to-rear direction, a plurality guide posts fixed on the base, a mounting seat sleeved movably on the guide posts, a motor disposed on the mounting seat, and a cutting unit disposed on the mounting seat. The cutting unit includes a rough-plane cutter, a fine-plane cutter disposed behind the rough-plane cutter, a first transmission unit interconnecting the motor and the rough-plane cutter to allow the rough-plane cutter to be driven by the motor, and a second transmission unit interconnecting the rough-plane cutter and the fine-plane cutter to allow rotation of the rough-plane cutter to be transferred to the fine-plane cutter.

14 Claims, 14 Drawing Sheets

WOOD PLANING MACHINE INCLUDING A ROUGH-PLANE CUTTER AND A FINE-PLANE CUTTER

CROSS-REFERENCE TO RELATED APPLICATION

This application claims priority of Chinese Application No. 200720146361.2, filed on Jun. 12, 2007.

BACKGROUND OF THE INVENTION

1. Field of the Invention

This invention relates to a wood planing machine, and more particularly to a wood planing machine including a rough-plane cutter and a fine-plane cutter.

2. Description of the Related Art

Referring to FIGS. 1, 2, and 3, a conventional wood planing machine 10 includes a base 11, four guide posts 12 fixed on the base 11, a mounting seat 13 sleeved movably on the guide posts 12, a motor 14 disposed on the mounting seat 13, a cutter 15 disposed rotatably on the mounting seat 13 and driven by the motor 14, a speed reduction unit 16 disposed on the mounting seat 13 and driven by the cutter 15, two pressing rollers 17 disposed rotatably on the mounting seat 13 and driven by the speed reduction unit 16, and a driving unit 18 for driving the mounting seat 13 to move vertically relative to the base 11. The cutter 15 is disposed between the pressing rollers 17.

During use, a wooden workpiece 20 is first placed onto the base 11. Next, the mounting seat 13 is moved downwardly through operation of the driving unit 18 until the cutter 15 abuts against the workpiece 20. Subsequently, the motor 14 is operated to cut the workpiece 20.

The aforesaid conventional wood planing machine 10 suffers from the following disadvantages:

Only a rough-plane cutting operation can be performed on the workpiece 20 by use of the cutter 15. To remove precisely a thickness from the workpiece 20, after the rough-plane cutting operation by the cutter 15 is finished, it is necessary to further machine the workpiece 20 through a fine-plane cutting operation or a grinding operation, thereby reducing the cutting efficiency and quality. Furthermore, due to the presence of another machine required for the fine-plane cutting operation or the grinding operation, the operating cost is increased.

SUMMARY OF THE INVENTION

The object of this invention is to provide a wood planing machine that includes a rough-plane cutter and a fine-plane cutter and that is able to improve the operating efficiency and quality and reduce the operating cost.

According to this invention, includes a base adapted to permit a workpiece to be moved thereon in a front-to-rear direction, a plurality guide posts fixed on the base, a mounting seat sleeved movably on the guide posts and, a motor disposed on the mounting seat, and a cutting unit disposed on the mounting seat. The cutting unit includes a rough-plane cutter, a fine-plane cutter disposed behind the rough-plane cutter, a first transmission unit interconnecting the motor and the rough-plane cutter to allow the rough-plane cutter to be driven by the motor, and a second transmission unit interconnecting the rough-plane cutter and the fine-plane cutter to allow rotation of the rough-plane cutter to be transferred to the fine-plane cutter.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
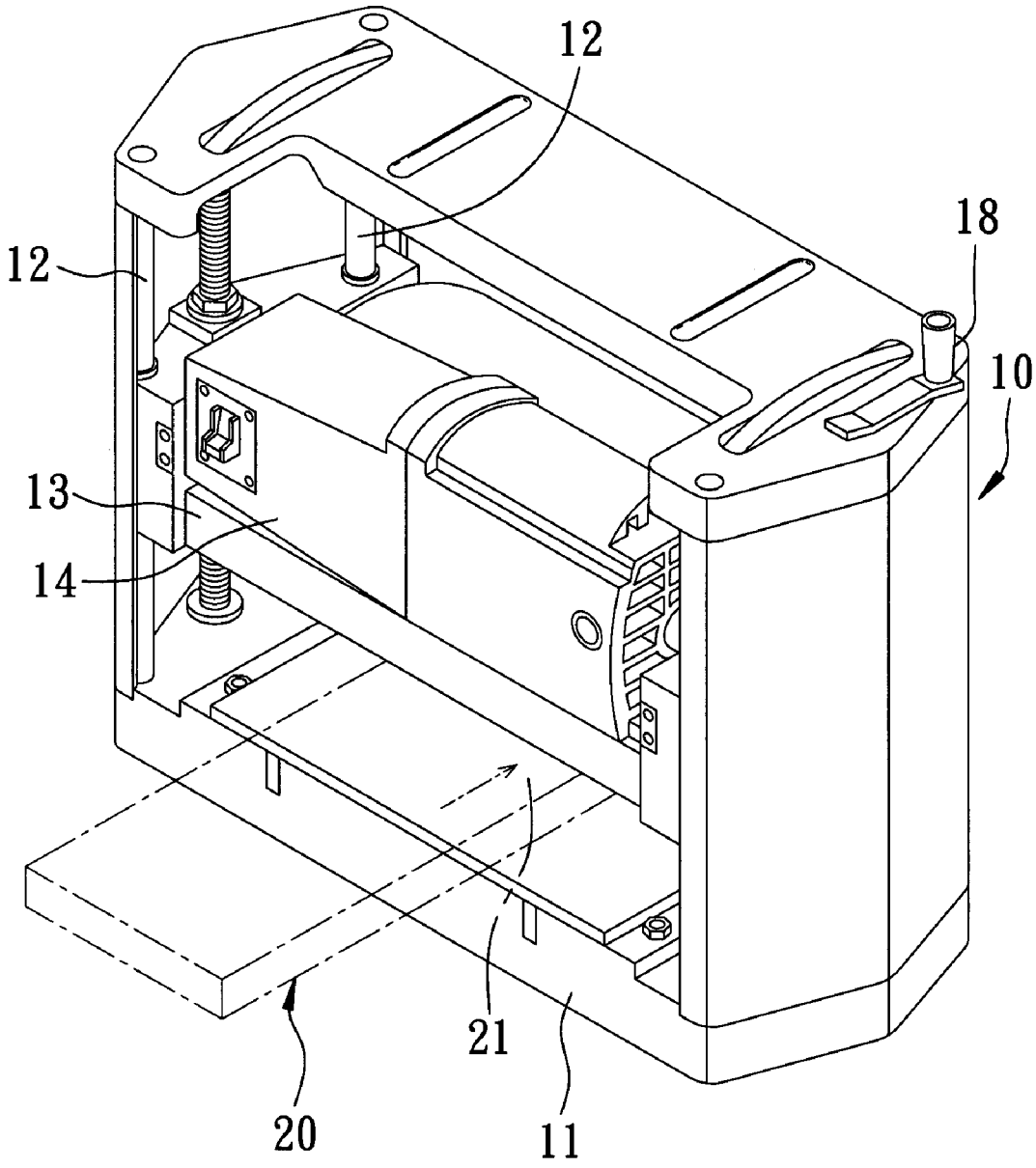
FIG. 1 PRIOR ART
FIG. 1 is a perspective view of a conventional wood planing machine.
Figure 2:
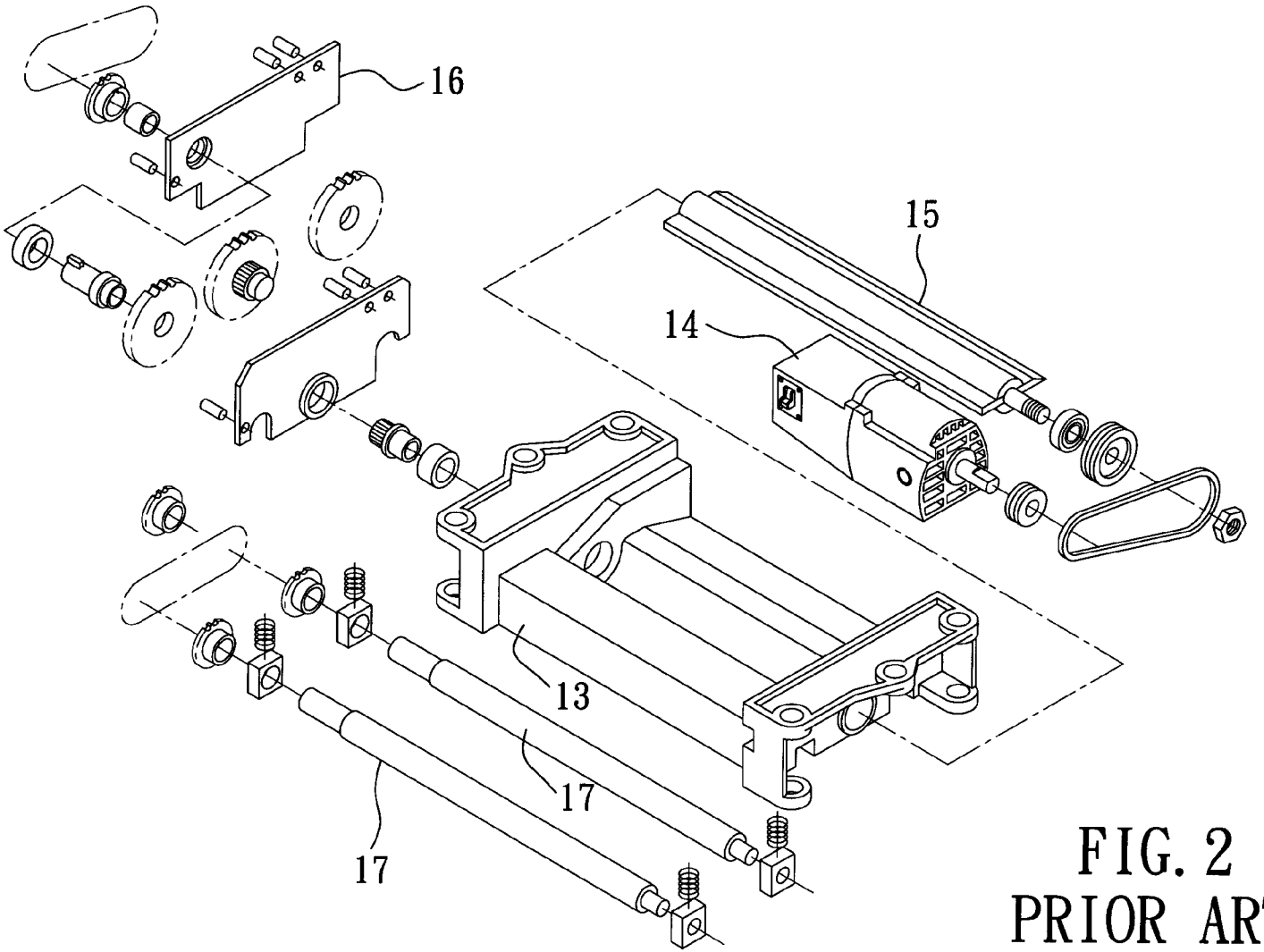
FIG. 2 PRIOR ART
FIG. 2 is a fragmentary exploded perspective view of the conventional wood planing machine.
Figure 3:
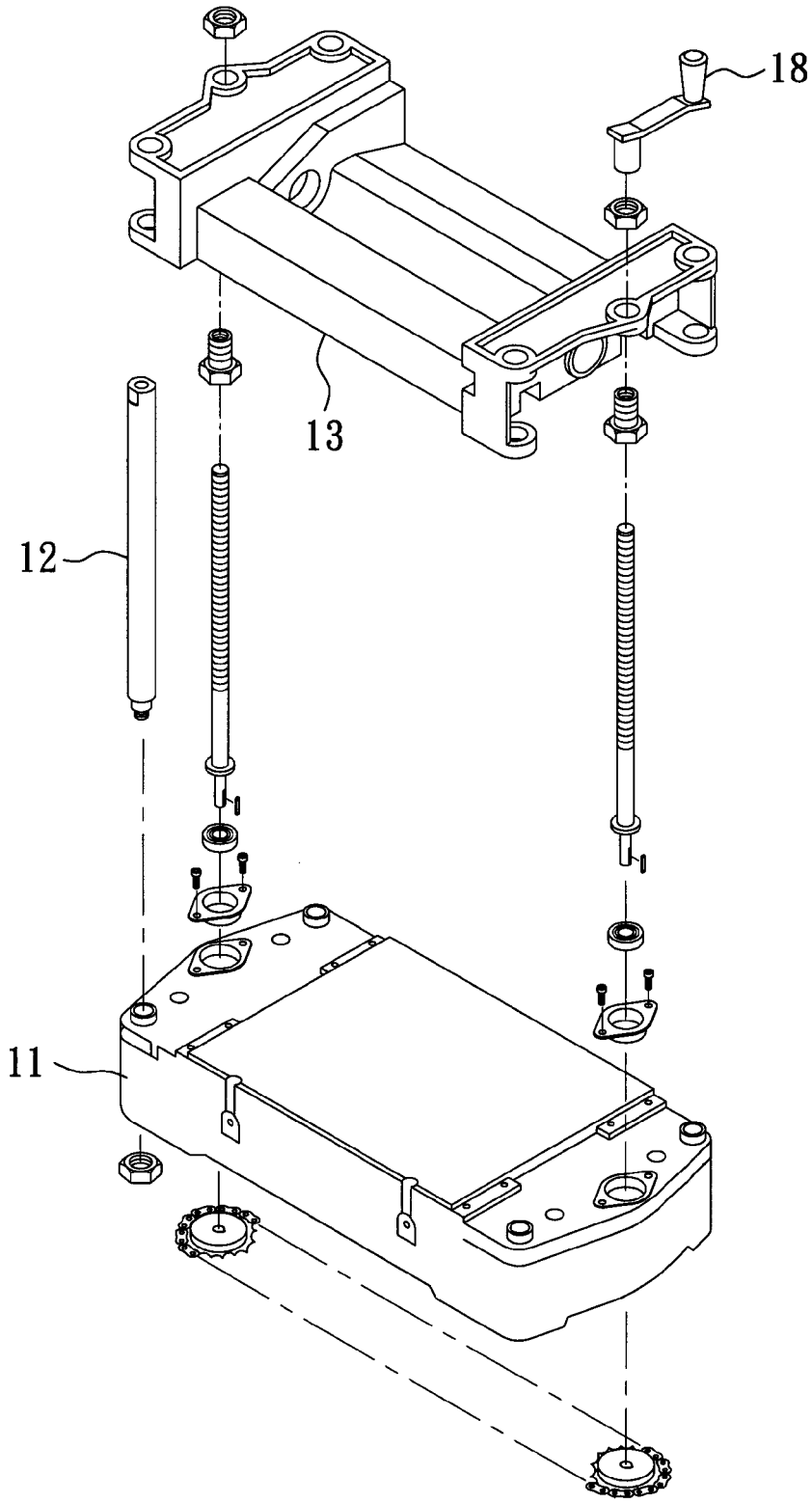
FIG. 3 PRIOR ART
FIG. 3 is a fragmentary exploded perspective view of the conventional wood planing machine, illustrating a driving unit.

Before the present invention is described in greater detail in connection with the preferred embodiments, it should be noted that similar elements and structures are designated by like reference numerals throughout the entire disclosure.

Figure 4:
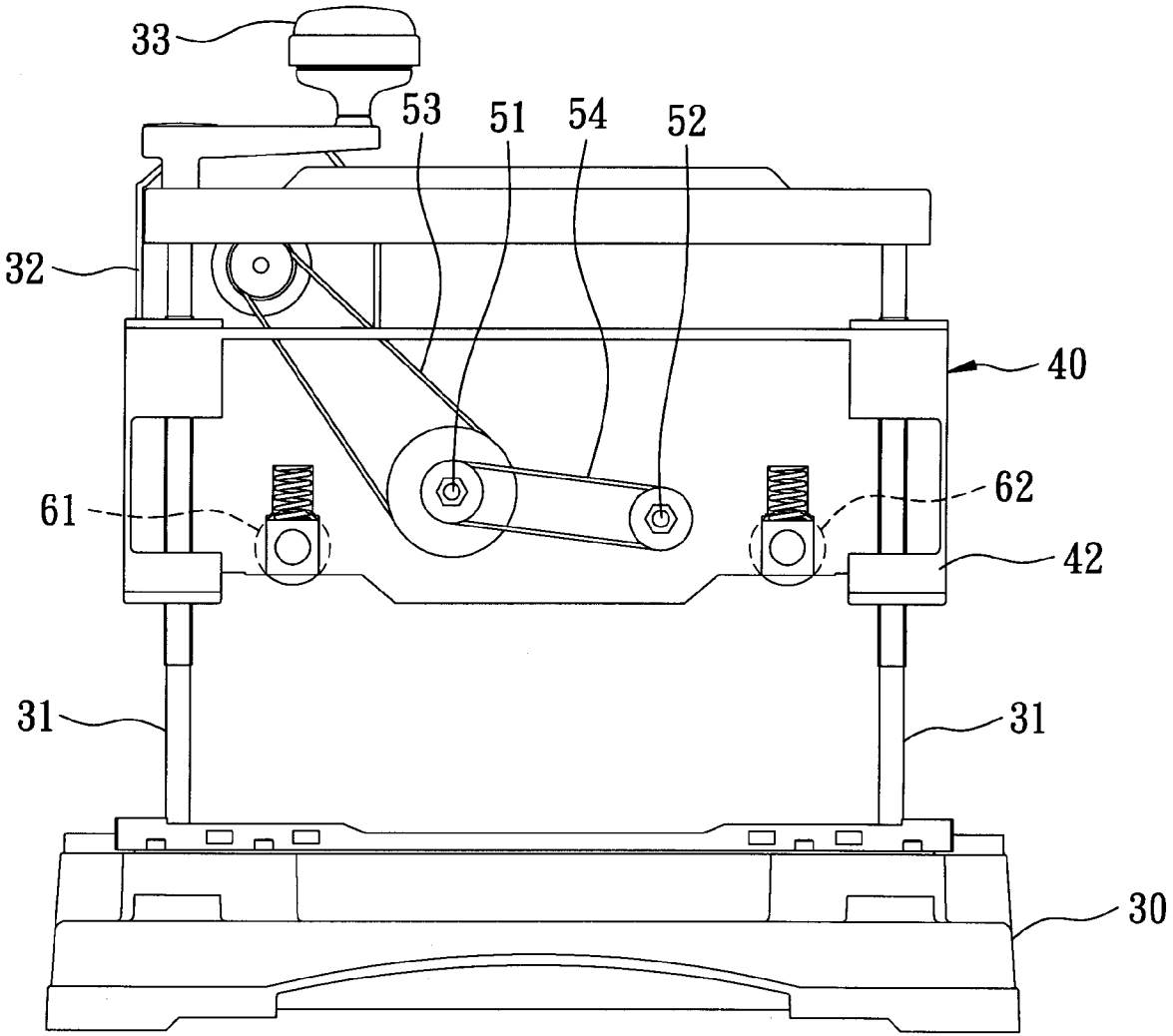
FIG. 4 is a right side view of the first preferred embodiment.
Figure 5:
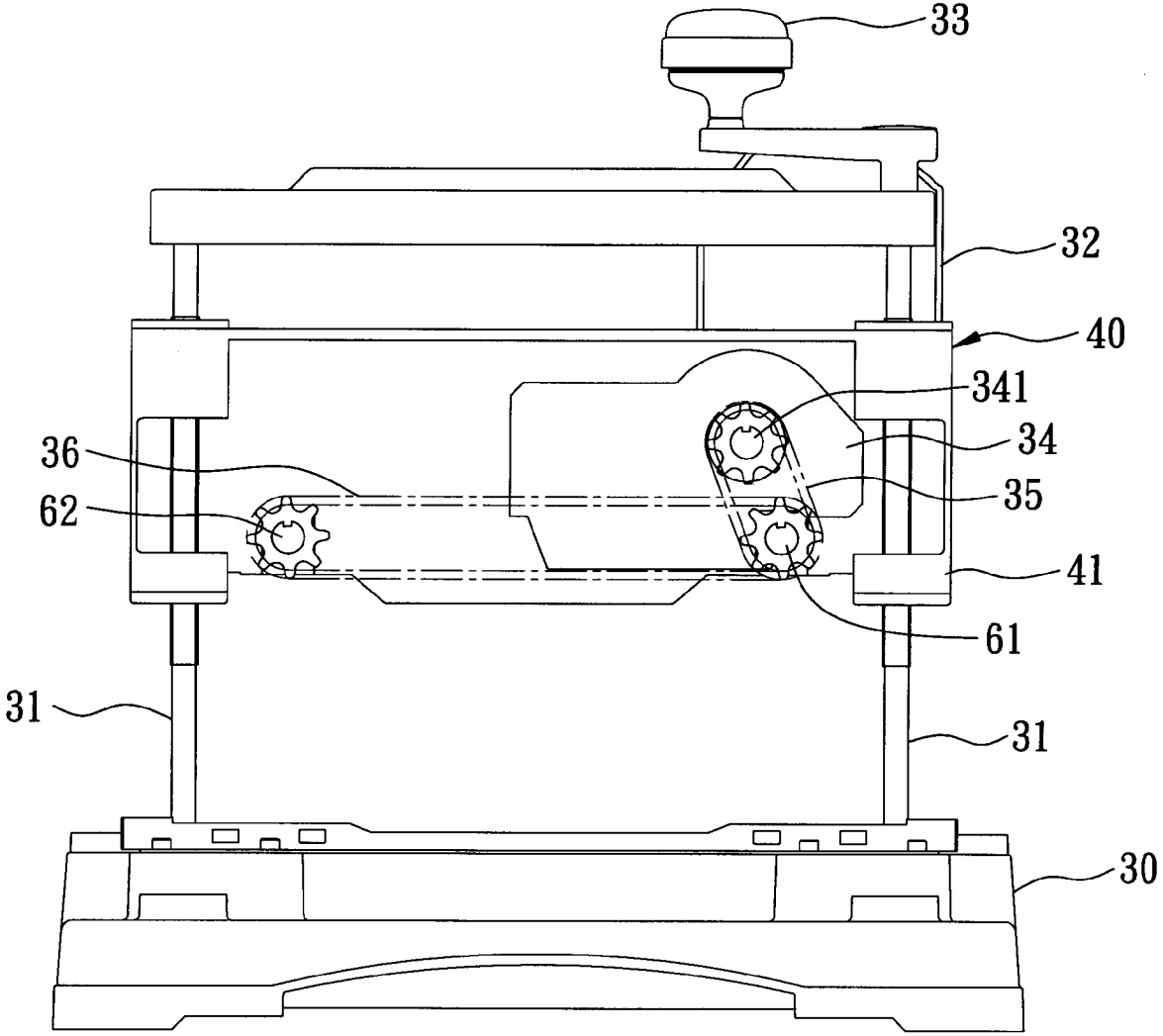
FIG. 5 is a left side view of the first preferred embodiment.
Figure 6:
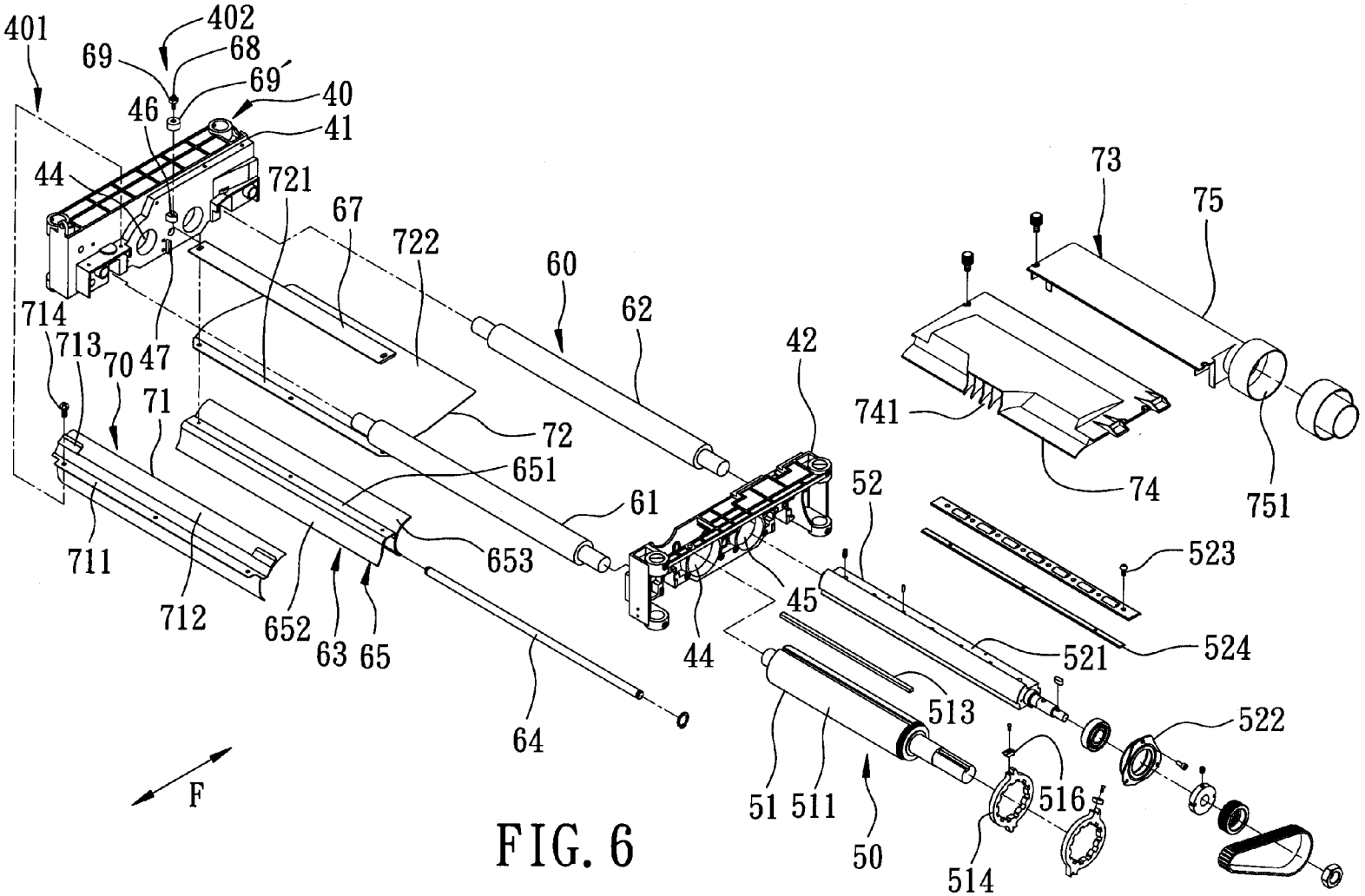
FIG. 6 is a fragmentary exploded perspective view of the first preferred embodiment.

Referring to FIGS. 4, 5, and 6, the first preferred embodiment of a wood planing machine according to this invention includes a base 30, four guide posts 31 fixed on the base 30, a mounting seat 40 sleeved movably on the guide posts 31, a motor 32 disposed on the mounting seat 40, a driving unit 33 for driving the mounting seat 40 to move vertically relative to the base 30, a speed reduction unit 34 disposed on a left side of the mounting seat 40, a cutting unit 50 mounted on the mounting seat 40, a pressing unit 60, and a woodchip-guiding unit 70. The base 30 permits a wooden workpiece 8 (see FIG. 8) to be moved thereon in a front-to-rear direction (F).

Since the base 30, the guide posts 31, the motor 32, and the driving unit 33 are similar in construction to the above-mentioned prior art, a further description thereof will be omitted herein.

The mounting seat 40 includes left and right side blocks 41, 42 each sleeved movably on two corresponding ones of the guide posts 31, two aligned front holes 44 formed respectively in the left and right side blocks 41, 42, two aligned rear holes 45 formed respectively in the left and right side blocks 41, 42, two mounting blocks 46 (only one is shown in FIG. 6) formed respectively in inner side surfaces of the left and right side blocks 41, 42, and two abutment blocks 47 (only one is shown in FIG. 6) formed respectively in inner side surfaces of the left and right side blocks 41, 42. For each of the left and right side blocks 41, 42, the mounting block 46 and the abutment block 47 are disposed between the front and rear holes 44, 45.

The cutting unit 50 includes a rough-plane cutter 51 having two ends disposed respectively and rotatably within the front holes 44 in the left and right side blocks 41, 42, and a fine-plane cutter 52 having two ends disposed respectively and rotatably within the rear holes 45 in the left and right side blocks 41, 42. As such, the rough-plane cutter 51 and the fine-plane cutter 52 are disposed respectively at front and rear seat portions 401, 402 of the mounting seat 40. The cutting unit 50 further includes a first transmission unit 53 in the form of a transmission belt and interconnecting the motor 32 and the rough-plane cutter 51 such that the rough-plane cutter 51 can be driven by the motor 32, and a second transmission unit 54 interconnecting the rough-plane cutter 51 and the fine-plane cutter 52 such that rotation of the rough-plane cutter 51 can be transferred to the fine-plane cutter 52.

Figure 7:
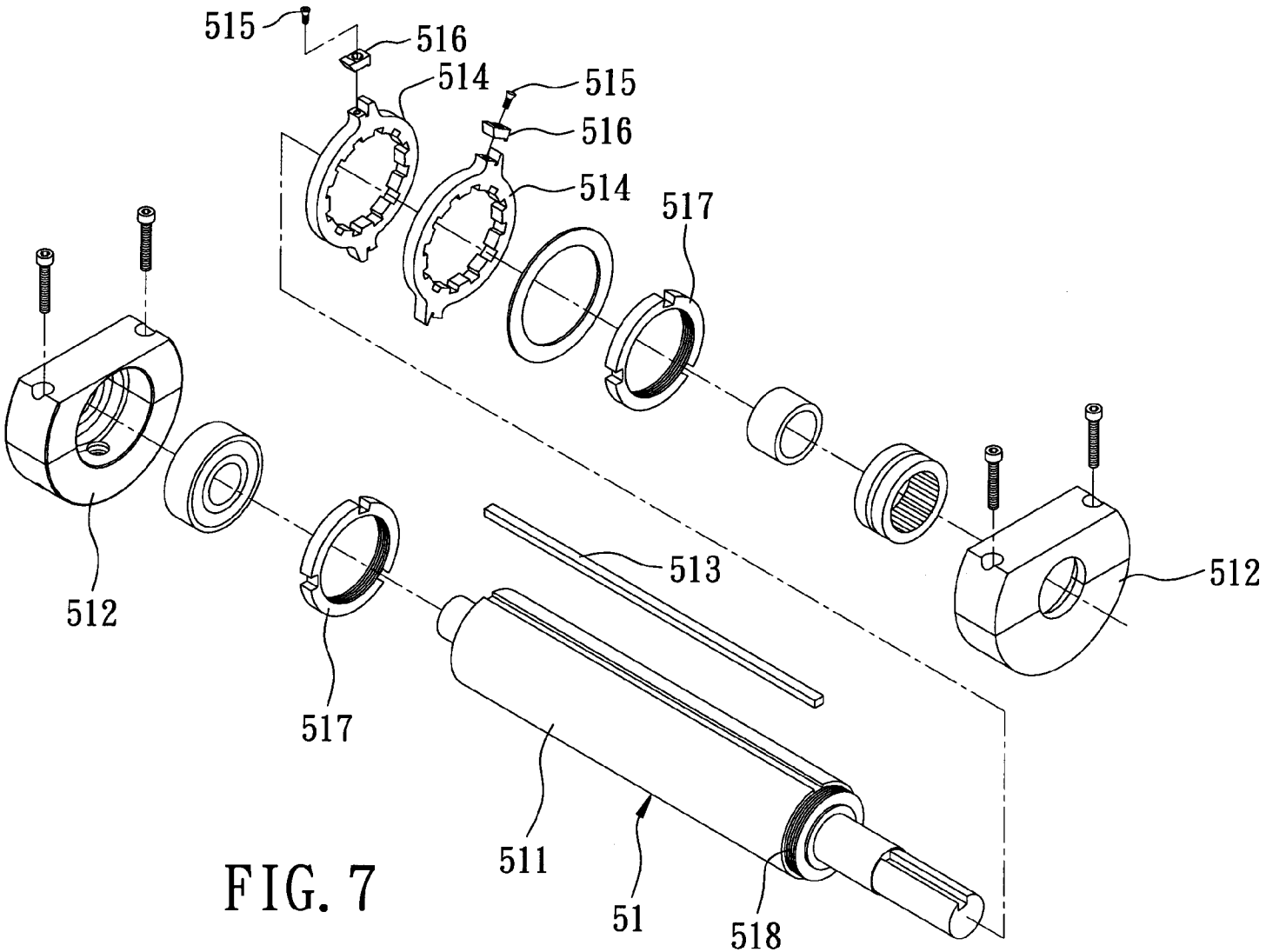
FIG. 7 is a fragmentary exploded perspective view of the first preferred embodiment, illustrating a rough-plane cutter.
Figure 8:
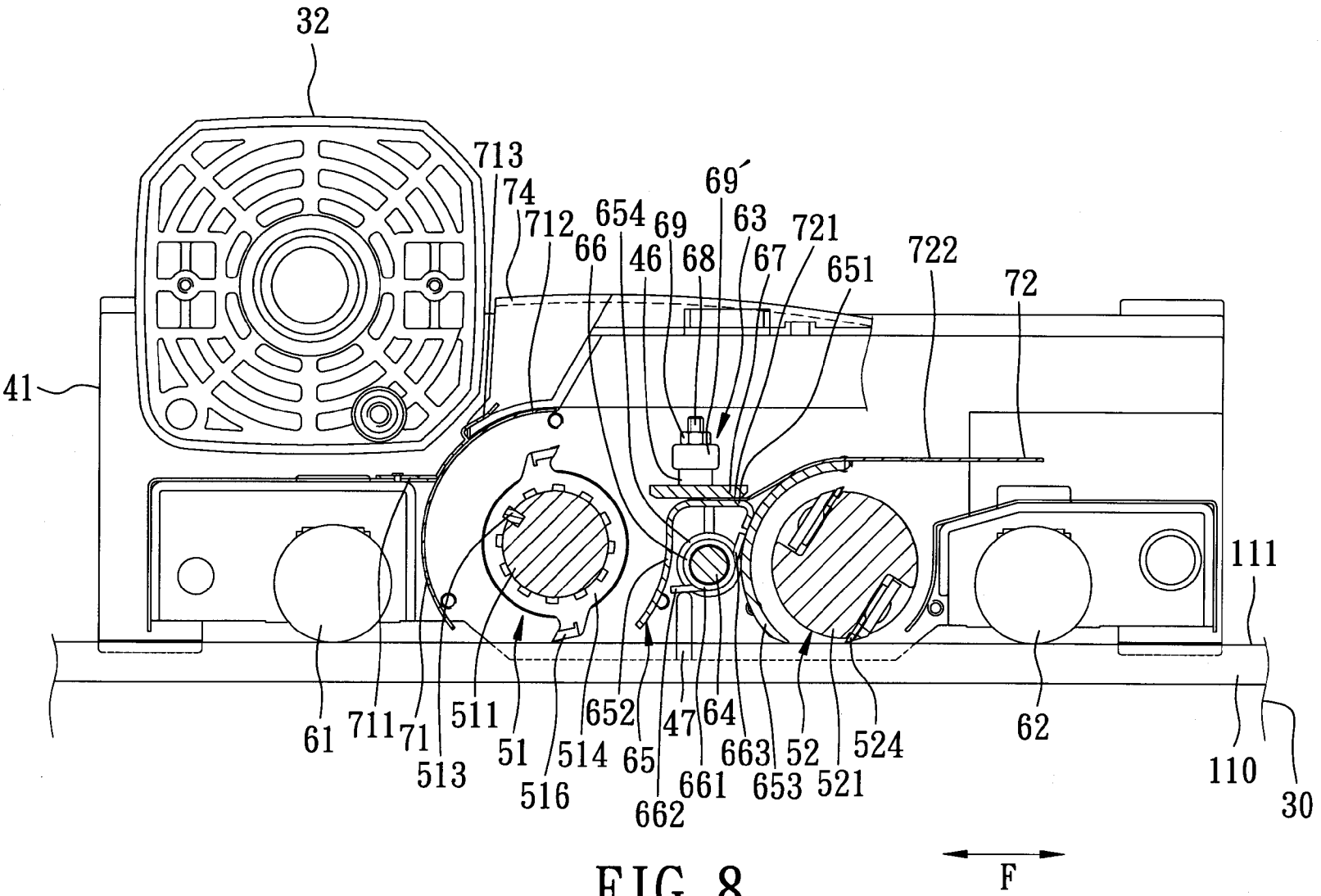
FIG. 8 is a partly sectional view of the first preferred embodiment in a state of use.

With further reference to FIGS. 7 and 8, the rough-plane cutter 51 includes a rotating shaft 511 disposed within the front holes 44 in the left and right side blocks 41, 42 by two bearings 512, a holder unit consisting of a plurality of cutter holders 514 sleeved on the rotating shaft 511, a key rod 513 engaging keyways in the rotating shaft 511 and the cutter holders 514 so as to prevent rotation of the cutter holders 514 on the rotating shaft 511, a blade unit consisting of a plurality pairs of blades 516 each pair locked releaseably on a respective one of the cutter holders 514 by a lock bolt 515, and two nuts 517 engaging respectively two externally threaded end portions 518 (only one is shown in FIG. 7) of the rotating shaft 511 so as to prevent movement of the cutter holders 514 on the rotating shaft 511. In this embodiment, the holder unit includes forty cutter holders 514 (only two are shown in FIGS. 6 and 7), and the blade unit includes eighty blades 516 (only two are shown in FIGS. 6 and 7). The blades 516 are disposed on the rotating shaft 511 in a helical arrangement.

The fine-plane cutter 52 includes a rotating shaft 521 disposed rotatably within the rear holes 45 in the left and right side blocks 41, 42 by two bearings 522, and two blades 524 (only one is shown in FIG. 6) each locked on the rotating shaft 521 by a plurality of lock bolts 523 (only one is shown in FIG. 6).

The pressing unit 60 includes a front pressing roller 61 disposed rotatably on and between the left and right side blocks 41, 42 and in front of the rough-plane cutter 51, a rear pressing roller 62 disposed rotatably on and between the left and right side blocks 41, 42 and behind the fine-plane cutter 52, and a middle pressing device 63 disposed between and on the left and right side blocks 41, 42 and located between the front and rear pressing rollers 61, 62. Each of the front and rear pressing rollers 61, 62 as well as the middle pressing device 63 is used for pressing a workpiece 110 (see FIG. 8) against the base 30.

The middle pressing device 63 includes a fixed shaft 64 disposed fixedly on the left and right side blocks 41, 42, a pressing member 65 sleeved on the fixed shaft 64, two resilient members 66 (not shown in FIG. 6, and only one is shown in FIG. 8) each sleeved on the fixed shaft 64 and pressing against the corresponding abutment block 47 and the pressing member 65 for biasing the pressing member 65 to press the workpiece 110 against the base 30, a pressing block 67 disposed on and directly above the pressing member 65, two vertical adjustment bolts 68 (only one is shown in FIG. 6) disposed respectively and rotatably on the mounting blocks 46 of the left and right side blocks 41, 42 and operable to adjust a pressure applied by the pressing member 65 to the workpiece 110, two nuts 69 engaging respectively the adjustment bolts 58 and disposed respectively above the mounting blocks 46, and two washers 69' each clamped between the corresponding nut 69 and the mounting block 46.

The pressing member 65 includes a top plate 651 disposed directly above the fixed shaft 64, a curved shielding plate 652 extending integrally, downwardly, and forwardly from a front end of the top plate 651 and disposed behind the rough-plane cutter 51, and a curved pressing plate 653 connected fixedly to and disposed behind the top plate 651 and having an upper end disposed directly above and adjacent to an upper end of the fine-plane cutter 52, and a lower end disposed in front of and adjacent to a lower end of the fine-plane cutter 52. The pressing member 65 further includes a sleeve 654 connected fixedly to the top plate 651 and sleeved on the fixed shaft 64.

Each of the resilient members 66 is configured as a torsion spring, and includes a spring body 661 sleeved on the fixed shaft 64 and pressing against the corresponding abutment block 47, and a second end foot 663 pressing against the pressing plate 653.

The adjustment bolts 68 extend through the pressing block 67, are connected to the top plate 651 of the pressing member 64, and are operable to move downwardly or upwardly. Downward movement of the adjustment bolts 68 results in upward pivoting movement of a lower end of the pressing plate 653. Upward movement of the adjustment bolts 68 results in downward pivoting movement of the lower end of the pressing plate 653.

With particular reference to FIG. 5, the speed reduction unit 34 includes an output shaft 341 connected to the front pressing roller 61 by a third transmission unit 35 in the form of a transmission belt. As such, rotation of the output shaft 341 can be transferred to the front pressing roller 61. The front pressing roller 61 is connected to the rear pressing roller 62 by a fourth transmission unit 36 in the form of a transmission belt. As such, rotation of the front pressing roller 61 can be transferred to the rear pressing roller 62.

With particular reference to FIGS. 6 and 8, the woodchip-guiding unit 70 includes a first woodchip-guiding cover 71, a second woodchip-guiding cover 72, and a woodchip-removing member 73.

The first woodchip-guiding cover 71 includes a mounting block 711 connected fixedly to the left and right side blocks 41, 42 by two lock bolts 714 (only one is shown in FIG. 6), a first guiding block 712 extending from the mounting block 711 and disposed in front of and adjacent to the rough-plane cutter 51, and two clamping blocks 713 extending respectively from two opposite end portions of the first guiding block 712.

The second woodchip-guiding cover 72 includes a mounting block 721 having a front end clamped between the top plate 651 of the pressing member 65 and the pressing block 67 such that the second woodchip-guiding cover 72 is disposed fixedly on the mounting seat 40, and a second guiding block 722 extending rearwardly from the mounting block 721 and located directly above the fine-plane cutter 52. The adjustment bolts 68 extend through the mounting block 721.

The woodchip-removing member 73 includes a woodchip-collecting cover 74 that is disposed on and above the first woodchip-guiding cover 71, that is clamped between the first guiding block 712 and the clamping blocks 713 at a front end thereof, and that is located directly above the second woodchip-guiding cover 72, and a woodchip-removing cover 75 mounted to the woodchip-collecting cover 74 and having a woodchip-discharging opening 751.

The woodchip-collecting cover 74 has an air inlet 741. The motor 32 can be operated to force air into the wood-chip cover 74 through the air inlet 741 to facilitate removal of woodchips.

During use, the workpiece 110 is first placed on the base 30. Next, the driving unit 33 is operated to move the mounting seat 40 downwardly until the rough-plane cutter 51 abuts against a top surface 111 of the workpiece 110. Subsequently, the motor 32 is operated to drive the rough-plane cutter 51 to perform a rough-cutting operation on the workpiece 110. When any portion of the workpiece 110 is moved rearwardly from the rough-plane cutter 51 to a position under the pressing member 65, it is pressed against the base 30 by the pressing member 65 to prevent vertical movement of the workpiece 110. When any portion of the workpiece 110 is moved rearwardly from the pressing member 65 onto the fine-plane cutter 52, a fine-plane cutting operation is performed thereon.

Figure 9:
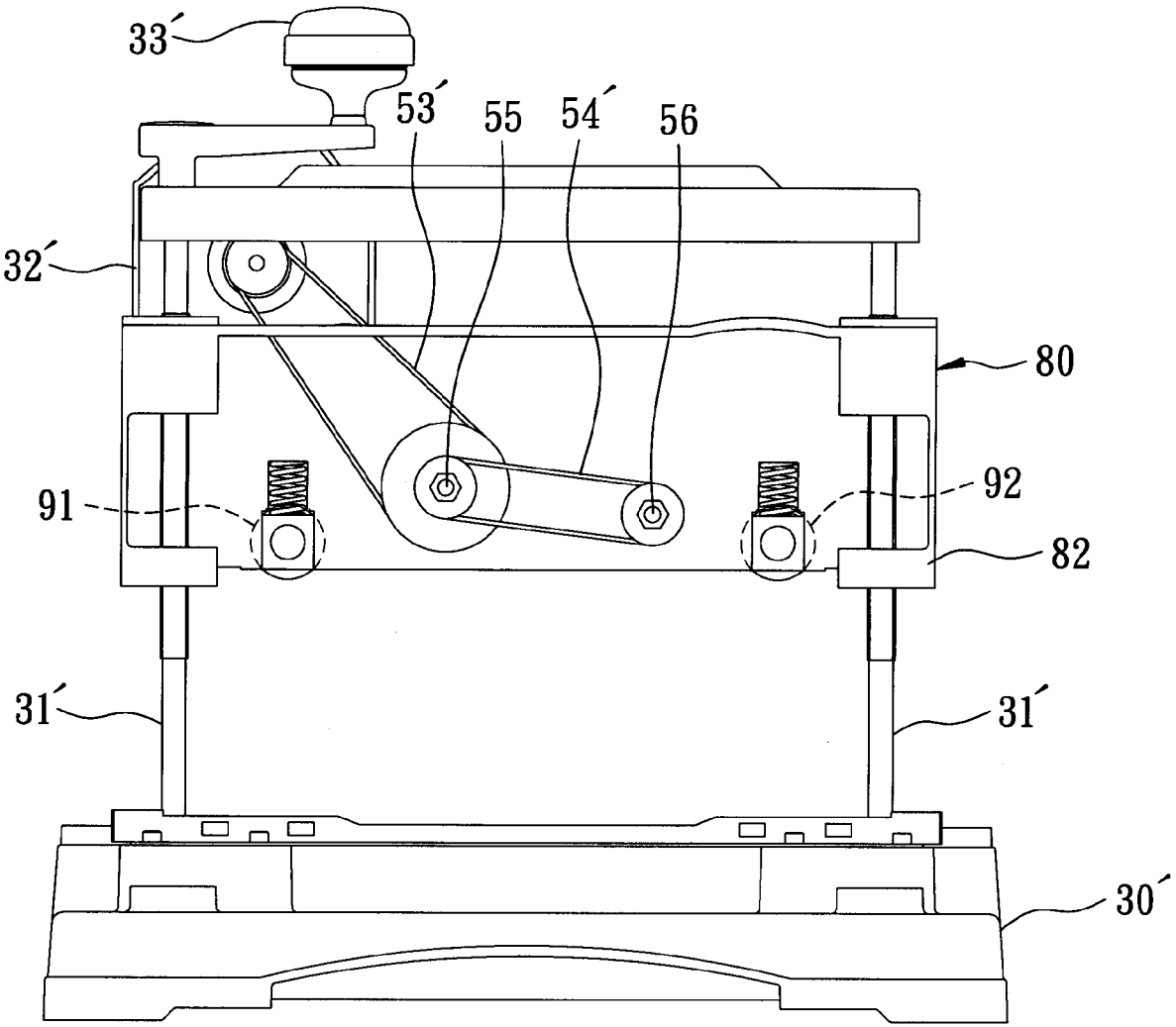
FIG. 9 is a right side view of the second preferred embodiment of a wood planing machine according to this invention.
Figure 10:
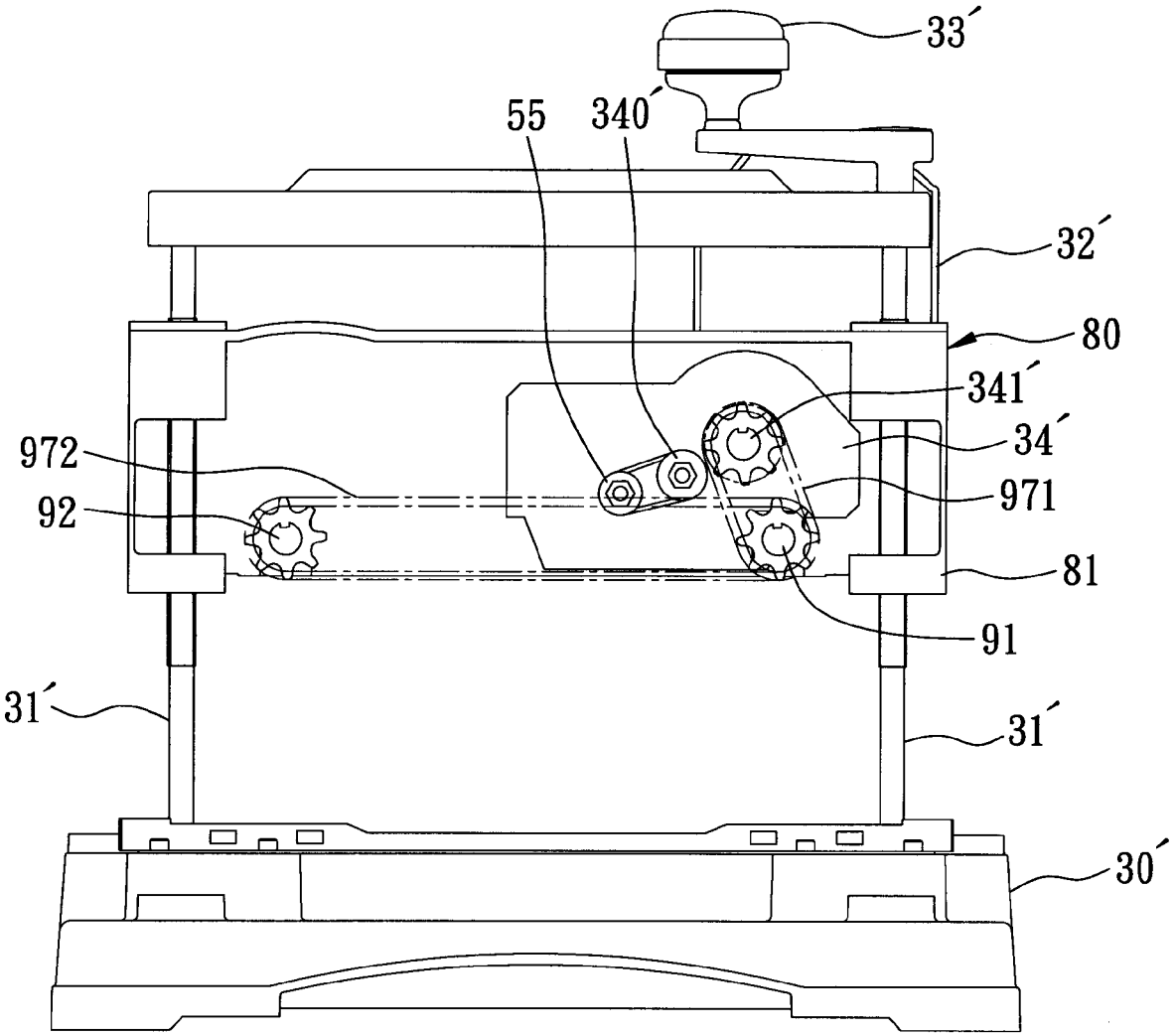
FIG. 10 is a left side view of the second preferred embodiment.
Figure 11:
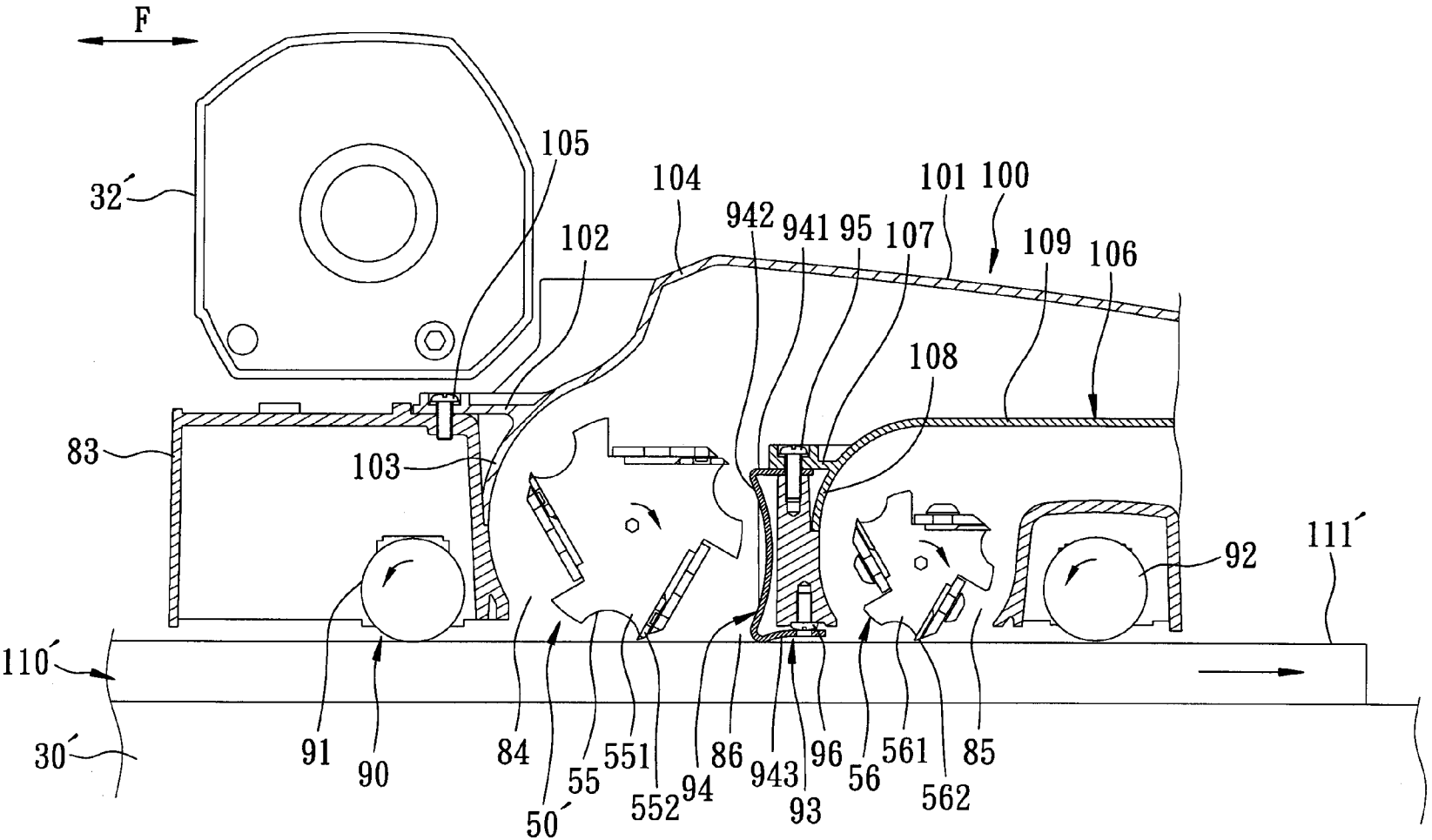
FIG. 11 is a partly sectional view of the second preferred embodiment in a state of use.

FIGS. 9, 10, and 11 show the second preferred embodiment of a wood planing machine according to this invention, which includes a base 30', four guide posts 31' fixed on the base 30', a mounting seat 80' sleeved movably on the guide posts 31', a motor 32' disposed on the mounting seat 80, a driving unit 33' for driving the mounting seat 80 to move vertically relative to the base 30', a speed reduction unit 34', a cutting unit 50', a pressing unit 90, and a woodchip-guiding unit 100. The speed reduction unit 34', the cutting unit 50', the pressing unit 90, and the woodchip-guiding unit 100 are disposed on the mounting seat 80.

Since the structures of the base 30', the guide posts 31', the motor 32', the driving unit 33', and the speed reduction unit 34' are known in the art, a further description thereof will be omitted herein.

The mounting seat 80 includes a pair of left and right side blocks 81, 82 each extending along a front-to-rear direction (F) and sleeved on two corresponding ones of the guide posts 31', a connecting block 83 interconnecting fixedly the left and right side blocks 81, 82, two front holes 84 formed respectively in the left and right side blocks 81, 82, two rear holes 85 formed respectively in the left and right side blocks 81, 82, and two middle holes 86 formed respectively in the left and right side blocks 81, 82.

The cutting unit 50' includes a rough-plane cutter 55 disposed rotatably within the front holes 84 in the left and right side blocks 81, 82, a fine-plane cutter 56 disposed rotatably within the rear holes 85 in the left and right side blocks 81, 82, a first transmission unit 53', and a second transmission unit 54'. The first transmission unit 53' interconnects the motor 32' and the rough-plane cutter 55 such that the rough-plane cutter 55 can be driven by the motor 32'. The second transmission unit 54' interconnects the rough-plane cutter 55 and the fine-plane cutter 56 such that rotation of the rough-plane cutter 55 can be transferred to the fine-plane cutter 56. An input shaft 340' of the speed reduction unit 34' is connected to the rough-plane cutter 55 such that rotation of the rough-plane cutter 55 can be transferred to the input shaft 340'. Each of the rough-plane cutter 55 and the fine-plane cutter 56 includes a rotating shaft 551, 561, and a plurality of blades 552, 562.

The pressing unit 90 includes a front pressing roller 91 mounted rotatably to the left and right side blocks 81, 82 of the mounting seat 80 and disposed in front of the rough-plane cutter 55, a rear pressing roller 92 mounted rotatably to the left and right side blocks 81, 82 of the mounting seat 80 and disposed behind the fine-plane cutter 56, and a middle pressing unit 93 disposed on the connecting block 83 and within the middle holes 86. The middle pressing unit 93 is located between the rough-plane cutter 55 and the fine-plane cutter 56.

The middle pressing unit 93 includes a pressing member 94, a plurality of lock bolts 95, and a plurality of adjustment bolts 96.

The pressing member 94 is configured as a resilient plate, and has a top plate portion 941 fixed to the connecting block 83 of the mounting seat 80 by the lock bolts 95, a connecting plate portion 942 extending from and disposed under the top plate portion 941, and a bottom pressing plate portion 943 extending rearwardly from a lower end of the connecting plate portion 942 and pressing against the top surface 111' of the workpiece 110'.

The adjustment bolts 96 are disposed rotatably on the connecting block 83, and have lower ends abutting against a rear end of the bottom pressing plate portion 943 of the pressing member 94. The adjustment bolts 96 are operable to press the rear end of the bottom plate portion 943 of the pressing member 94 against the workpiece 110'.

Rotation of an output shaft 341' of the speed reduction unit 34' is transferred to the front pressing roller 91 by a third transmission unit 971. Rotation of the front pressing roller 91 is transferred to the rear pressing roller 92 by a fourth transmission unit 972.

The woodchip-guiding unit 100 includes a first woodchip-guiding cover 101 and a second woodchip-guiding cover 106.

The first woodchip-guiding cover 101 includes a mounting block 102 disposed fixedly on the connecting block 83 of the mounting seat 80 by a plurality of lock bolts 105 (only one is shown in FIG. 11), a front shielding block 103 extending forwardly and downwardly from the mounting block 102 and disposed in front of and adjacent to the rough-plane cutter 55, and a top shielding block 104 extending rearwardly and upwardly from the mounting block 102 and disposed directly above the rough-plane cutter 55. The front shielding block 103 has a lower end abutting against the connecting block 83.

The second woodchip-guiding cover 106 includes a mounting block 107 disposed fixedly on the connecting block 83, a front shielding block 108 extending forwardly and downwardly from the mounting block 107 and disposed in front of and adjacent to the fine-plane cutter 56, and a top shielding block 109 extending rearwardly and upwardly from the mounting block 107 and disposed directly above the fine-plane cutter 56 and under the top shielding block 104 of the first woodchip-guiding cover 101.

Figure 12:
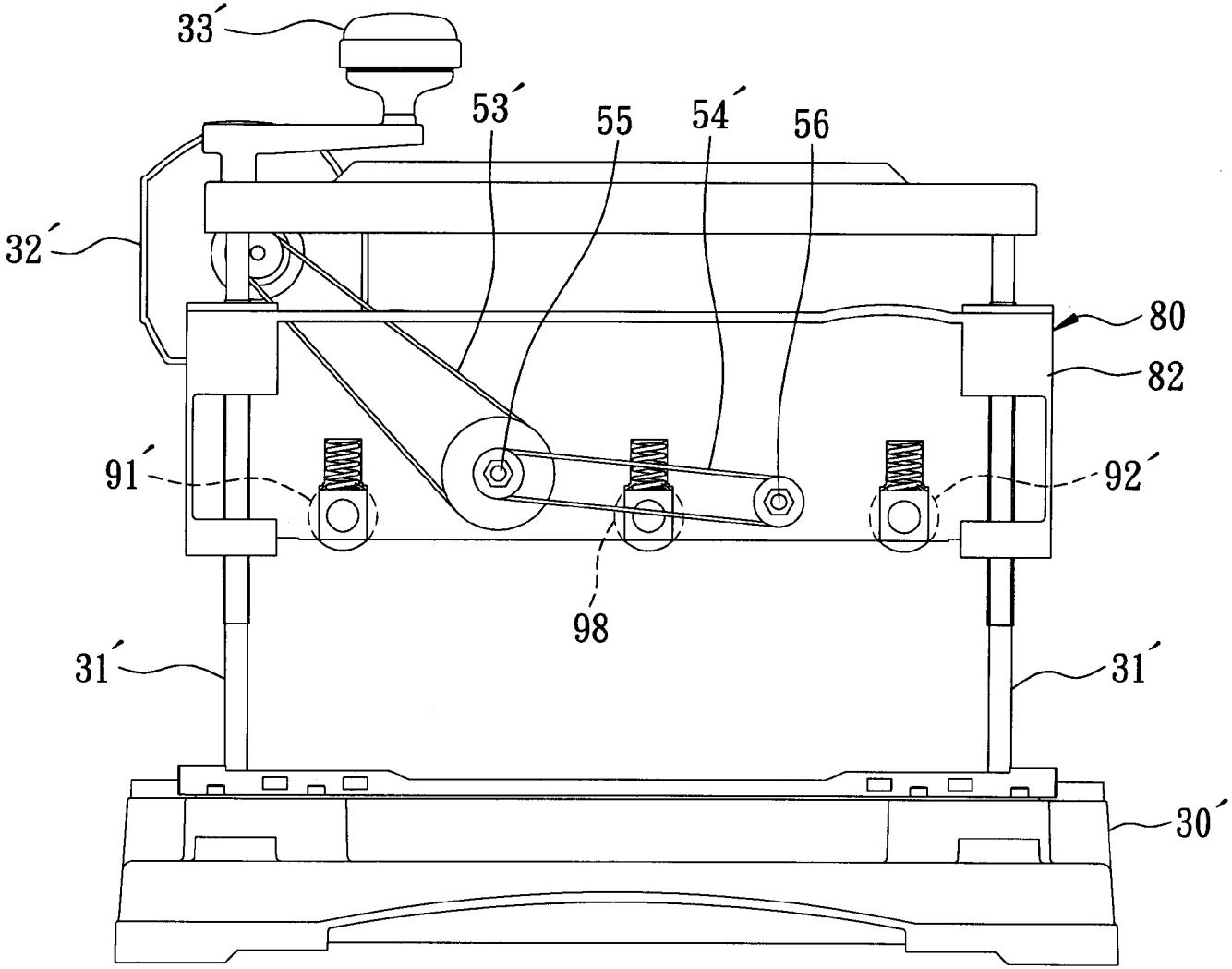
FIG. 12 is a right side view of the third preferred embodiment of a wood planing machine according to this invention.
Figure 13:
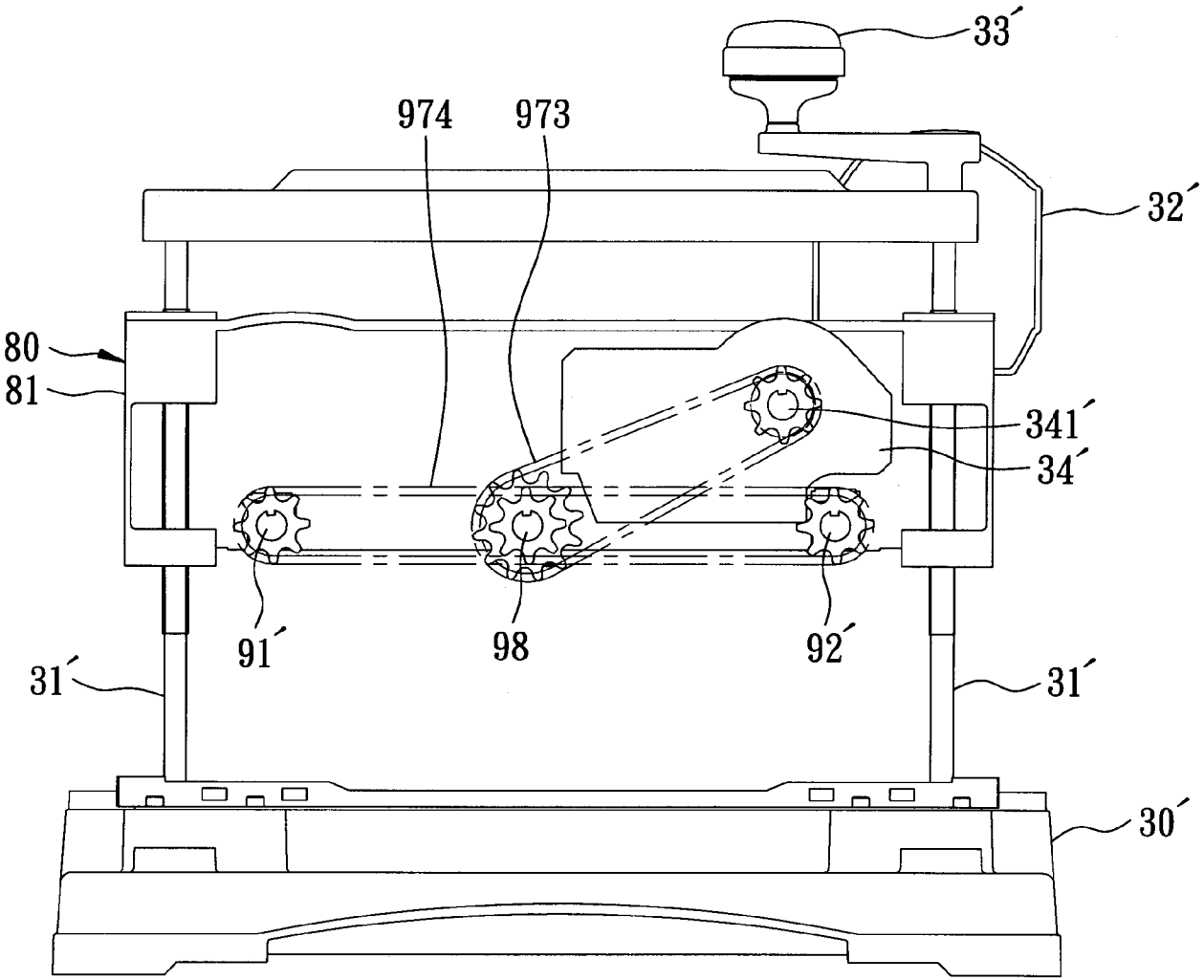
FIG. 13 is a left side view of the third preferred embodiment.
Figure 14:
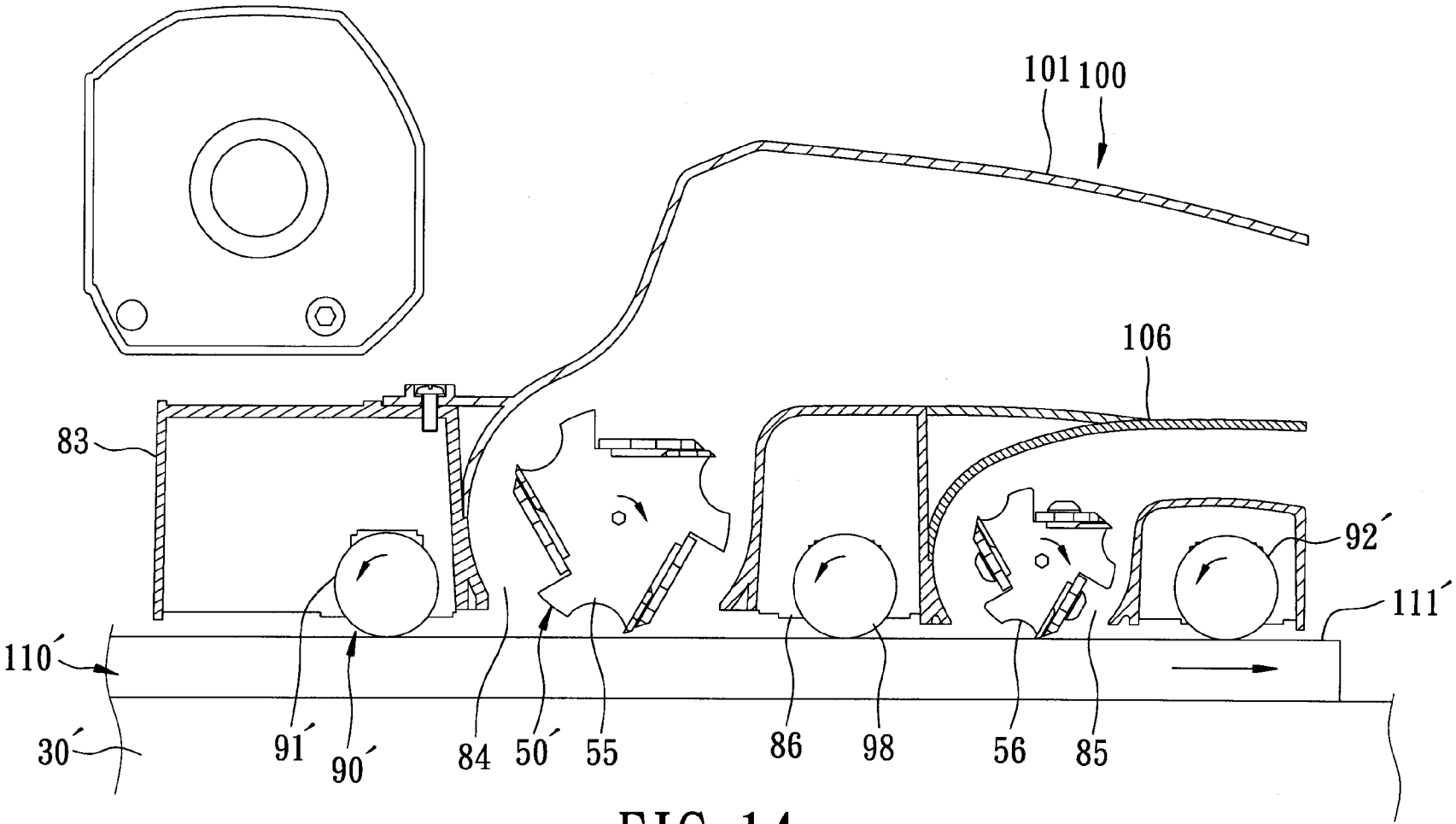
FIG. 14 is a partly sectional view of the third preferred embodiment in a state of use.

FIGS. 12, 13, and 14 show the third preferred embodiment of a wood planing machine according to this invention, which is similar in construction to the second preferred embodiment except that the pressing unit 90' includes a front pressing roller 91', a rear pressing roller 92', and a middle pressing roller 98'.

The front pressing roller 91' is disposed rotatably within the front holes 84 in the left and right side blocks 81, 82 and in front of the rough-plane cutter 55.

The rear pressing roller 92' is disposed rotatably within the rear holes 85 in the left and right side blocks 81, 82 and behind the fine-plane cutter 56.

The middle pressing roller 98 is disposed rotatably within the middle holes 86 in the left and right side blocks 81, 82 and between the rough-plane cutter 55 and the fine-plane cutter 56.

In this embodiment, the functions of the first and second transmission units 53', 54' are the same as those of the second preferred embodiment, a third transmission unit 973 is used for transferring rotation of the output shaft 341' of the speed reduction unit 34' to the middle pressing roller 98, and a fourth transmission unit 974 is used for transferring rotation of the middle pressing roller 98 to the front and rear pressing roller 91', 92'.

In view of the above, the wood planing machine of this invention has the following advantages:

When the rough-plane cutter 51, 55 and the fine-plane cutter 52, 56 are rotated and when the workpiece 110, 110' is moved rearwardly on the base 30, 30' along the front-to-rear direction (F), the rough-plane cutting and fine-plane cutting operations are performed consecutively on the workpiece 110, 110'. As a consequence, the operating efficiency and quality are improved. Furthermore, since the rough-plane and fine-plane cutting operations are performed by use of the same wood planing machine, the operating cost is reduced. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. A wood planing machine comprising:

a base adapted to permit a workpiece to be moved thereon in a front-to-rear direction;

a plurality guide posts fixed on said base;

a mounting seat sleeved movably on said guide posts and having a front seat portion and a rear seat portion disposed behind said front seat portion;

a motor disposed on said mounting seat; and a cutting unit including a rough-plane cutter mounted rotatably on said front seat portion of said mounting seat, a fine-plane cutter mounted rotatably on said rear seat portion of said mounting seat, a first transmission unit interconnecting said motor and said rough-plane cutter such that said rough-plane cutter is driven by said motor, and a second transmission unit interconnecting said rough-plane cutter and said fine-plane cutter such that rotation of said rough-plane cutter is transferred to said fine-plane cutter.

2. The wood planing machine as claimed in claim 1, further comprising a pressing unit including a front pressing roller disposed rotatably on said mounting seat and in front of said rough-plane cutter and adapted for pressing the workpiece against said base, a rear pressing roller disposed rotatably on said mounting seat and behind said fine-plane cutter and adapted for pressing the workpiece against said base, and a middle pressing device disposed on said mounting seat and between said rough-plane cutter and said fine-plane cutter and adapted for pressing the workpiece against said base.

3. The wood planing machine as claimed in claim 2, wherein said middle pressing device includes:

a fixed shaft fixed on said mounting seat and between said rough-plane cutter and said fine-plane cutter;

a pressing member sleeved on said fixed shaft;

at least one resilient member sleeved on said fixed shaft and adapted for biasing said pressing member to press the workpiece against said base; and an adjustment bolt disposed rotatably on said mounting seat and operable to adjust a pressure applied by said pressing member to the workpiece.

4. The wood planing machine as claimed in claim 3, wherein said pressing member of said middle pressing device includes:

a top plate disposed directly above said fixed shaft and having a front end;

a curved shielding plate extending integrally, downwardly, and forwardly from said front end of said top plate and disposed behind said rough-plane cutter;

a curved pressing plate connected fixedly to and disposed behind said top plate and having an upper end disposed directly above and adjacent to an upper end of said fine-plane cutter, and a lower end disposed in front of and adjacent to a lower end of said fine-plane cutter, and a sleeve connected fixedly to said top plate and sleeved on said fixed shaft.

5. The wood planing machine as claimed in claim 4, wherein said resilient member is configured as a torsion spring, and includes a spring body sleeved on said fixed shaft, a first end foot pressing against said mounting seat, and a second end foot pressing against said pressing plate.

6. The wood planing machine as claimed in claim 5, further comprising a woodchip-collecting unit including:

a first woodchip-guiding cover disposed fixedly on said mounting seat and in front of and adjacent to said rough-plane cutter; and a second woodchip-guiding cover disposed fixedly on said mounting seat and directly above said fine-plane cutter.

7. The wood planing machine as claimed in claim 6, wherein said second woodchip-guiding cover has a front end, and said middle pressing device further includes a pressing block disposed on and above said top plate of said pressing member such that said front end of said second woodchip-guiding cover is clamped between said pressing block and said top plate of said pressing member.

8. The wood planing machine as claimed in claim 7, wherein said mounting seat includes a mounting block disposed directly above said top plate of said pressing member of said middle pressing unit, said adjustment bolt being vertical, being disposed rotatably on said mounting block, and being connected to said top plate of said pressing member, said middle pressing device further including a nut engaging said adjustment bolt and disposed above said mounting block.

9. The wood planing machine as claimed in claim 2, wherein said mounting seat includes two side blocks each sleeved movably on corresponding ones of said guide posts, and a connecting block interconnecting fixedly said side blocks, said middle pressing device including a pressing member and a plurality of lock bolts, said pressing member being configured as a resilient plate and having a top plate portion fixed to said mounting seat by said lock bolts, a connecting plate portion extending from and disposed under said top plate portion and having a lower end, and a bottom pressing plate portion extending rearwardly from said lower end of said connecting plate portion and adapted for pressing the workpiece against said base.

10. The wood planing machine as claimed in claim 9, wherein said middle pressing device further includes a plurality of adjustment bolts disposed rotatably on said mounting seat and having lower ends abutting against a rear end of said bottom pressing plate portion, said adjustment bolts being operable to press said rear end of said bottom plate portion of said pressing member against the workpiece.

11. The wood planing machine as claimed in claim 10, further comprising a woodchip-guiding unit including:

a first woodchip-guiding cover including a mounting block disposed fixedly on said connecting block of said mounting seat, a front shielding block extending forwardly and downwardly from said mounting block of said first woodchip-guiding cover and disposed in front of and adjacent to said rough-plane cutter, said front shielding block having a lower end abutting against said connecting block of said mounting seat, and a top shielding block extending rearwardly and upwardly from said mounting block of said second woodchip-guiding cover and disposed directly above said rough-plane cutter; and a second woodchip-guiding cover including a mounting block disposed fixedly on said connecting block of said mounting seat, a front shielding block extending forwardly and downwardly from said mounting block of said second woodchip-guiding cover and disposed in front of and adjacent to said fine-plane cutter, and a top shielding block extending rearwardly and upwardly from said mounting block of said second woodchip-guiding cover and disposed directly above said fine-plane cutter and under said top shielding block of said first woodchip-guiding cover.

12. The wood planing machine as claimed in claim 2, further comprising:

a speed reduction unit including an input shaft driven by said rough-plane cutter, and an output shaft;

a third transmission unit for transferring rotation of the output shaft to said front pressing roller; and a fourth transmission unit for transferring rotation of said front pressing roller to said rear pressing roller.

13. The wood planing machine as claimed in claim 1, further comprising:

a pressing unit including a front pressing roller disposed rotatably on said mounting seat and in front of said rough-plane cutter, a rear pressing roller disposed rotatably on said mounting seat and behind said fine-plane cutter, and a middle pressing roller disposed rotatably on said mounting seat and between said rough-plane cutter and said fine-plane cutter;

a speed reduction unit including an input shaft driven by said rough-plane cutter, and an output shaft;

a third transmission unit for transferring rotation of said output shaft to said middle pressing roller; and a fourth transmission unit for transferring rotation of said middle pressing roller to said front and rear pressing rollers.

14. The wood planing machine as claimed in claim 1, wherein said rough-plane cutter includes a rotating shaft disposed rotatably said mounting seat, a plurality of cutter holders sleeved fixedly on said rotating shaft, and a plurality of blades locked respectively and releaseably on said cutter holders and disposed on said rotating shaft in a helical arrangement.

* * * * *